US006854150B2

(12) United States Patent
Hirse

(10) Patent No.: US 6,854,150 B2
(45) Date of Patent: Feb. 15, 2005

(54) FLOOR MOP

(75) Inventor: Gernot M. Hirse, Frankfurt (DE)

(73) Assignee: Carl Freudenberg KG, Weinheim (DE)

( * ) Notice: Subject to any disclaimer, the term of this patent is extended or adjusted under 35 U.S.C. 154(b) by 0 days.

(21) Appl. No.: 09/994,983

(22) Filed: Nov. 26, 2001

(65) Prior Publication Data

US 2002/0120994 A1 Sep. 5, 2002

(30) Foreign Application Priority Data

Nov. 25, 2000 (DE) ..... 100 58 630

(51) Int. Cl.[7] ..... A47L 13/146
(52) U.S. Cl. ..... 15/119.2; 15/244.2; 15/228
(58) Field of Search ..... 15/116.2, 119.2, 15/116.1, 119.1, 244.1, 244.2, 228

(56) References Cited

U.S. PATENT DOCUMENTS

| | | | | | |
|---|---|---|---|---|---|
| 2,730,744 | A | * | 1/1956 | Vaughn | 15/119.2 |
| 2,892,201 | A | * | 6/1959 | Peterson et al. | 15/119.2 |
| 3,224,025 | A | * | 12/1965 | Altrock | 15/119.2 |
| 4,831,677 | A | * | 5/1989 | Morrison et al. | 15/119.2 |
| 5,272,783 | A | * | 12/1993 | Richardson et al. | 15/119.2 |
| 5,483,720 | A | | 1/1996 | Decoopman et al. | 15/119.2 |
| 5,896,613 | A | | 4/1999 | Courtney et al. | |
| 6,119,297 | A | * | 9/2000 | Ohm et al. | 15/119.2 |
| 6,330,084 | B1 | * | 12/2001 | Chiang | 358/497 |
| 2002/0056167 | A1 | * | 5/2002 | Ohm et al. | 15/119.2 |

FOREIGN PATENT DOCUMENTS

| | | | | |
|---|---|---|---|---|
| BE | 496850 | * | 11/1950 | 15/119.2 |
| CA | 0466474 | * | 7/1950 | 15/119.2 |
| DE | 216565 | * | 11/1909 | 15/119.2 |
| NO | 76184 | * | 1/1950 | 15/119.2 |
| WO | 96/08991 | | 3/1996 | |
| WO | WO 99/09876 | | 3/1999 | |

* cited by examiner

*Primary Examiner*—Gary K. Graham
(74) *Attorney, Agent, or Firm*—Kenyon & Kenyon

(57) ABSTRACT

A floor mop has two carrier plates (5) that are connected with a common carrier center piece (3) in jointed manner and carry an absorbent mop covering (6). A mop handle (1) is affixed on the carrier center piece (3) by way of a cardan joint (2), in jointed manner. A wringer slide (9) that can be moved along the mop handle (1) and is guided not to rotate has two rigid wringer arms (11), the ends (11*a*) of which can each be brought into engagement with a guide surface (17) on the back of the carrier plate (5) assigned to them, in each instance, by way of rollers (12).

18 Claims, 3 Drawing Sheets

FLOOR MOP

Figure 3:
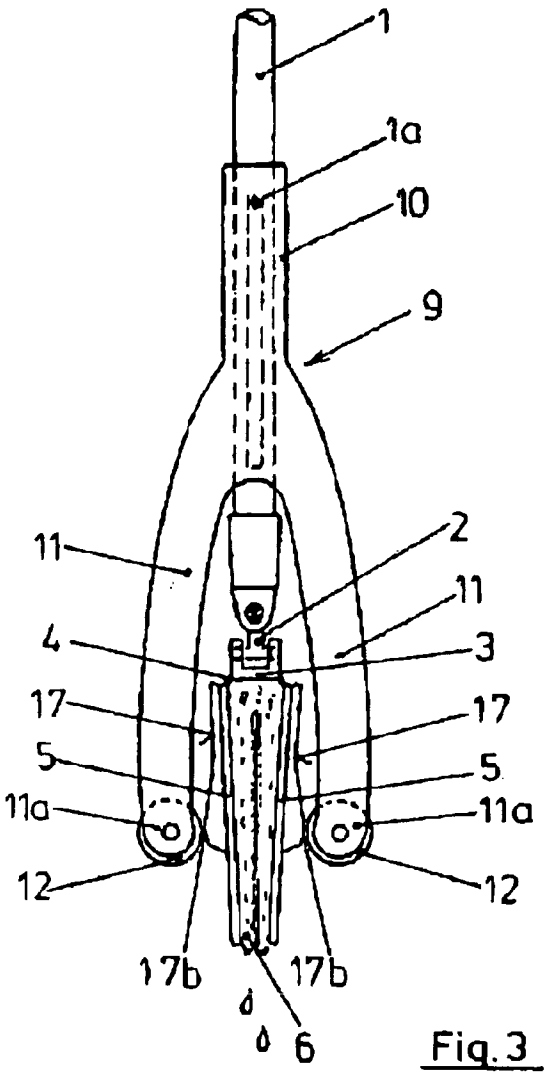

The invention relates to a floor mop with two carrier plates that are connected with a common carrier center piece in jointed manner and carry an absorbent mop covering, and a mop handle affixed on a carrier center piece, as well as a wringer slide that can be moved along the mop handle, with two rigid wringer arms, each of which is movably connected with the back of one of the carrier plates.

Floor mops with two carrier plates that can be tilted towards one another to wring out the mop covering, also referred to as butterfly floor mops, are known in various embodiments. In the floor mops according to U.S. Pat. No. 5,483,720 and PCT/US/95/10759, a sleeve that can be moved along the mop handle is connected with two stirrups mounted, via a guide piece, to pivot on the carrier center piece; when the sleeve is moved, these stirrups slide along the back of the two carrier plates and press them together. In this connection, however, the mop handle must be rigidly connected with the carrier center piece. Because of this rigid connection, the usage possibilities are limited, because only a specific slanted position of the mop handle relative to the carrier plates is predetermined in this working position.

In another known floor mop of the species indicated initially, the ends of the wringer arms that are rigidly connected with the wringer slide are connected with the back of each carrier plate, via a guide piece, in each instance. When the wringer slide is pushed downward on the mop handle, the two guide pieces act as jointed pressure struts that press the two carrier plates against one another, in order to wring out the mop covering that is located between them. Here again, the angular position of the mop handle relative to the carrier plates is predetermined in the working position, so that the usage possibilities are limited.

It is therefore the object of the present invention to structure a floor mop of the species indicated initially in such a way that an extensively unlimited angular position of the mop handle relative to the carrier plates in the working position is made possible, while maintaining the simple and effective wringing possibility.

This object is achieved, according to the present invention, in that the mop handle is connected with the carrier center piece by way of a cardan joint, and that the ends of the wringer arms can each be brought into engagement with a guide surface on the back of the carrier plate assigned to them, in each instance, and that the wringer slide is guided on the mop handle so that it cannot rotate.

Connecting the mop handle with the carrier plates by way of a cardan joint makes it possible, for one thing, to achieve a freely selectable and modifiable angular position of the mop handle relative to the carrier plates, where, however, a secure guidance possibility of the carrier plates by the mop handle remains guaranteed, because of the non-rotating connection via the cardan joint. The carrier plates, which lie flat on the floor in their working position, in their extended arrangement, can be guided towards all the edges and corners of the floor area to be cleaned, with a universal access possibility to all floor regions being guaranteed by the angular position of the mop handle, which can be chosen to be any desired position.

Since there is no connection between the wringer arms and the carrier plates in the retracted position of the wringer slide, the wringer device does not hinder free pivoting of the mop handle relative to the carrier plates, over a wide range.

The simple contact engagement between the ends of the wringer arms and the backs of the carrier plates has the result that the carrier plates are moved from any desired working position that they may have been in, when the wringer slide is moved forward, into their wringing position, in which the wringer arms are moved along the guide surface on the back of each carrier plate, in order to finally press the two carrier plates completely against one another, so that an effective and complete wringing process is guaranteed.

The non-rotating guidance of the wringer slide, in interaction with the non-rotating connection between the mop handle and the carrier plates in the cardan joint, ensures that the wringer arms will always reliably contact the back of the carrier plates when the wringer slide is moved forward, and go into engagement with them.

In accordance with a preferred exemplary embodiment of the invention, it is provided that the guide surface of each carrier plate rises to an elevation that projects from this back of the carrier plate, in the direction towards the free end of the carrier plate. In this way, a reinforced, final compression of the carrier plates is achieved at the end of the wringing movement.

Preferably, the guide surface decreases in height on the side of the elevation facing the free end of the carrier plate. This has the result that the force to be exerted on the wringer slide decreases after the elevations have been crossed, at the end of the wringing process, thereby giving the user a clear sign that the wringing process has been carried out completely and has been concluded.

Other advantageous further developments of the idea of the present invention are the object of additional dependent claims. Exemplary embodiments of the invention will be explained in greater detail below, as shown in the drawings.

Figure 1:
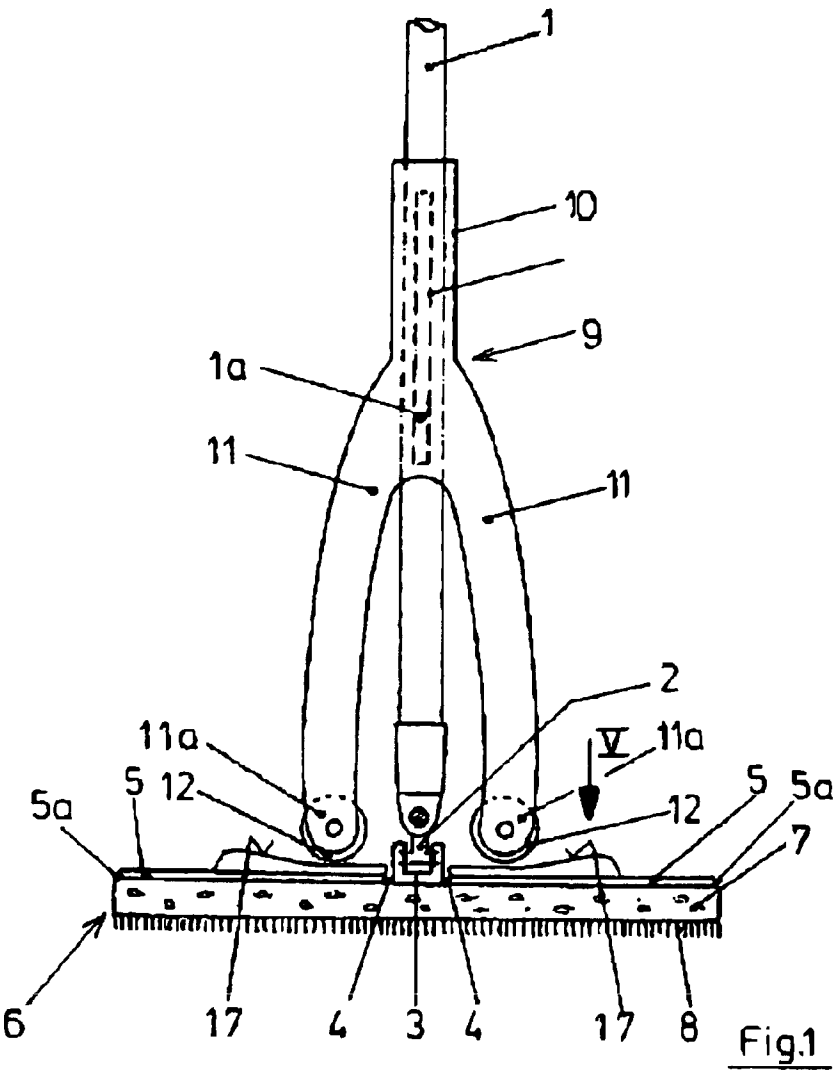
Figure 4:
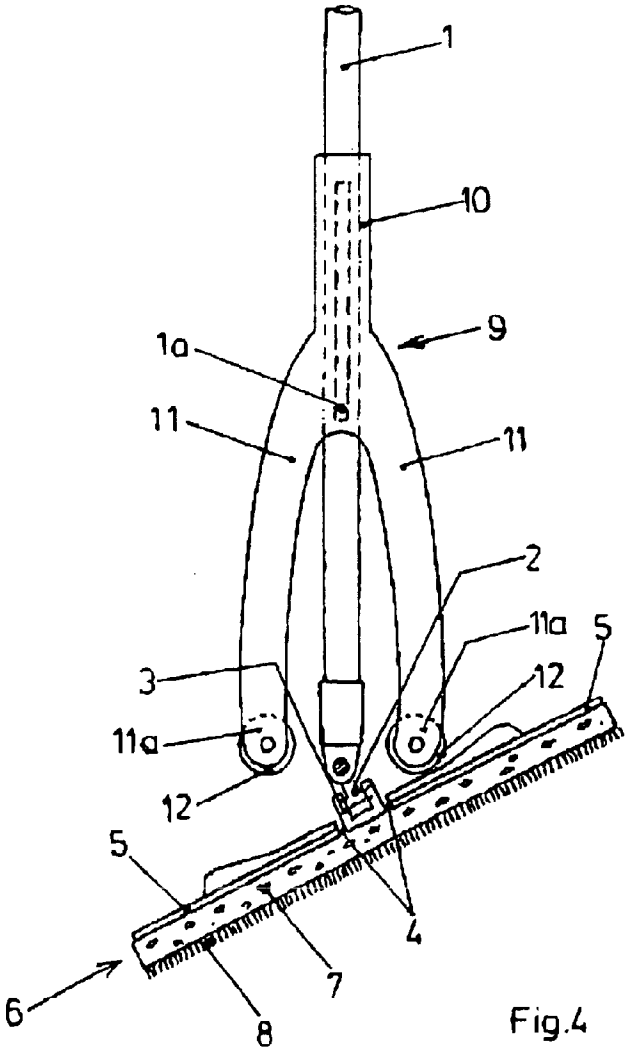
Figure 2:
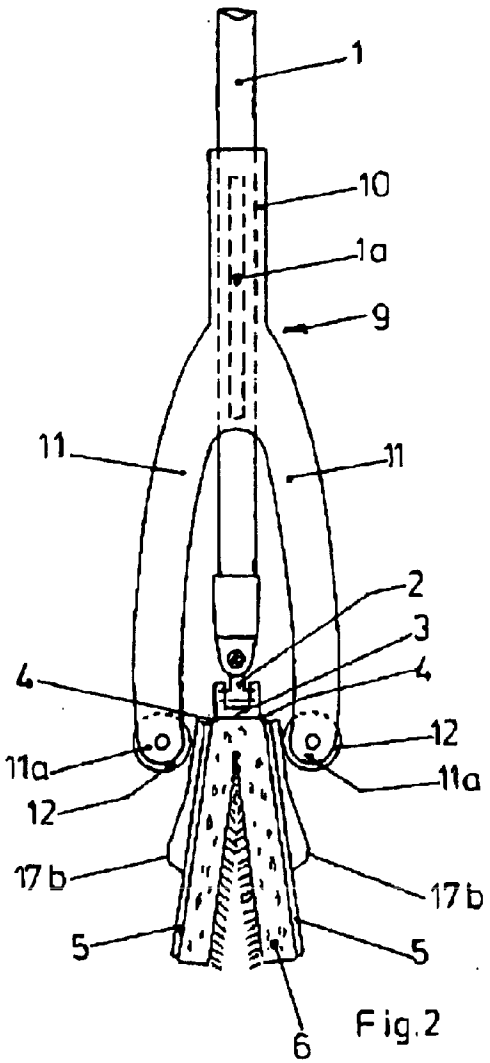
Figure 7:
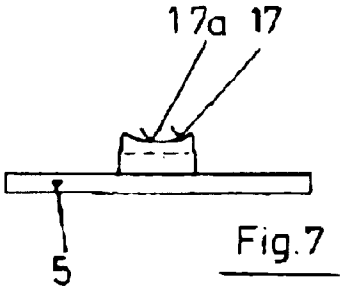
Figure 8:
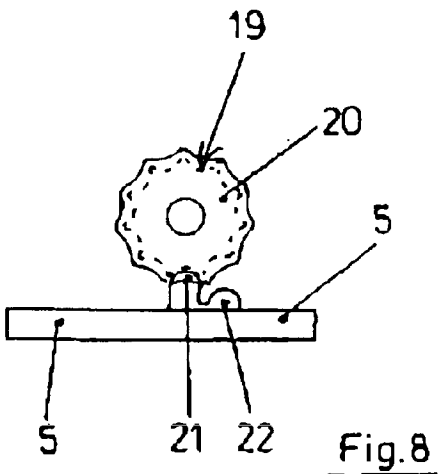
Figure 5:
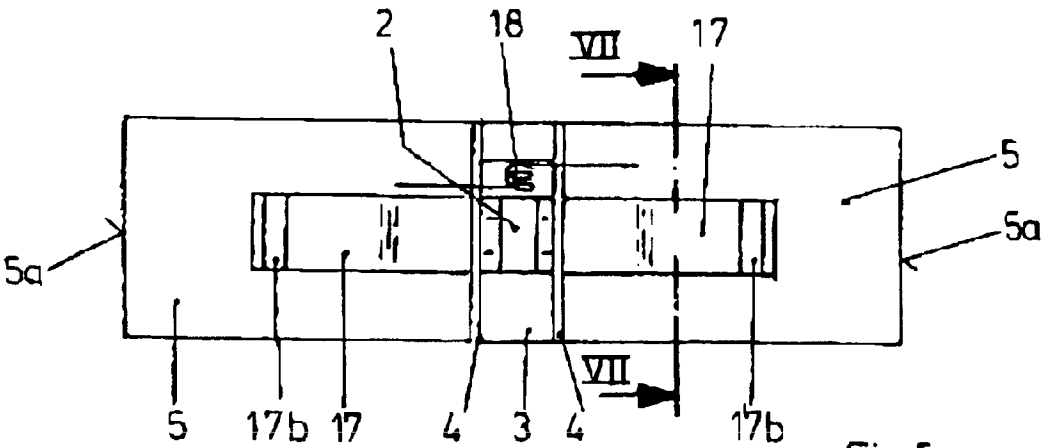

These show:

FIG. 1 a floor mop in a side view, in its working position,

FIG. 2 the floor mop according to FIG. 1, at the beginning of the wringing process, FIG. 3 the floor mop according to FIGS. 1 and 2 at the end of the wringing process, FIG. 4 the floor mop according to FIGS. 1–3 in a working position with the mop handle angled off to the side, FIG. 5 a top view in the direction of the arrow V in FIG. 1, where the mop handle and the wringer slide have been left out, FIGS. 6*a*)–*d*) partial representations of different embodiments of the roller elements and/or the curved contact surface at the end of a wringer arm, FIG. 7 a cross-section along the line VII—VII in FIG. 5, and FIG. 8 a simplified partial representation of a modified embodiment of the roller element at the end of the wringer arm.

The floor mop shown in FIGS. 1–5 has a mop handle 1 that is connected, via a cardan joint 2, with a carrier center piece 3 so that it cannot rotate, but can pivot to all sides. Carrier center piece 3 is connected with a carrier plate 5 on both sides, via hinges 4.

The two carrier plates 5 (and, in the exemplary embodiment shown, also carrier center piece 3) carry an absorbent mop covering 6 that can be wrung out, which is made up, in conventional manner, of a sponge layer 7 and a pile cover 8.

A wringer slide 9 can be moved along mop handle 1. Wringer slide 9 has a guide sleeve 10 that is guided to move along the length of mop handle 1, so as not to rotate. For example, a lengthwise groove 10*a* is provided in the bore of sleeve 10, into which a pin 1*a* affixed to mop handle 1 engages.

Sleeve 10 is rigidly connected with two wringer arms 11, which each carry a roller 12, mounted to rotate, at their ends 11*a*, as rotating roller elements, in the exemplary embodiment shown in FIGS. 1–5.

Figure 6:
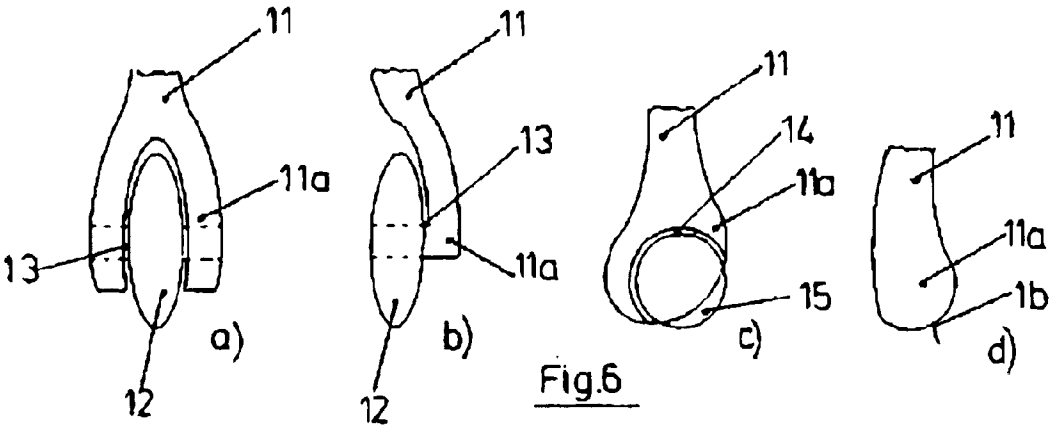

FIG. 6 shows that the roller 12 is mounted on an axle 13, which can be affixed to wringer arm 11 on both sides (FIG. 6*a*) or one side (FIG. 6*b*). Instead, it is also possible (FIG. 6*c*) to provide a ball 15 which is held to rotate in a recess 14 at end 11*a* of wringer arm 11, as a roller element. Another possible alternative is for end 11*a* of each wringer arm 11 to have a pressure surface 16 with a convex curvature (FIG. 6*d*).

If wringer slide 9 is moved downward on mop handle 7, in order to initiate a wringing process, rollers 12 (or, in comparable manner, ball 15 or curved pressure surface 16) engage with a guide surface 17 on the back of carrier plate 5 assigned to them, in each instance. In this way, the two carrier plates 5 are pivoted towards one another, as shown in FIG. 2 at the beginning of the wringing process. For better guidance of rollers 12, ball 15, or pressure surface 16, guide surface 17 can have a flat longitudinal groove 17*a* that is concave in cross-section, in each instance (FIG. 7).

The two guide surfaces 17 on the back of each carrier plate 5 rise to an elevation 17*b*, which projects out of the back of carrier plate 5, in the direction towards free plate end 5*a*.

At the end of the wringing process, which is shown in FIG. 3, rollers 12 have reached these elevations 17*b*, which causes the two carrier plates 5 to be tilted into their most extreme wringing position relative to one another. In this connection, it can be provided that rollers 12 go slightly beyond elevations 17*b*, so that a decrease in the advancing force to be exerted on wringer slide 9 gives the user a feeling for the fact that the end point of the wringing process has been exceeded.

From this wringing position (FIG. 3), wringer slide 9 is retracted into its starting position. In this connection, the two carrier plates 5 are moved back into their extended position by a spring device, for example a shank spring 18 (FIG. 5), the shanks of which are connected with carrier plates 5.

FIG. 4 shows that wringer slide 9 can be retracted so far that the two rollers 12 release carrier plates 5 to such an extent that they can also be pivoted sufficiently towards the side, as shown in FIG. 4.

FIG. 8 shows another modified embodiment in which the roller element is a wheel 20 provided with recesses 19 on its circumference and attached to wringer arm 11, which engages with at least one projection 21 or 22 on the back of carrier plate 5, at the end of the wringing process.

What is claimed is:

1. A floor mop comprising: two carrier plates connected to a common carrier center piece in jointed manner and which carry an absorbent mop covering, a mop handle affixed on the carrier center piece, and a wringer slide which is movable along the mop handle, the wringer slide having two rigid wringer arms, each of which is movably engagable with a back of one of the two carrier plates, wherein the mop handle (1) is connected with the carrier center piece (3) by way of a cardan joint (2), and ends (11*a*) of the wringer arms (11) can each be brought into engagement with a guide surface (17) on the back of the carrier plate (5) assigned to them, in each instance, and the wringer slide (9) is guided on the mop handle (1) so that it cannot rotate, wherein the arms move into and out of engagement with the carrier plates, and the ends of the arms are configured with roller elements such that each of the roller elements contacts the back of one of the two carrier plates and each of the roller elements may independently be disengaged from the back of the carrier plate while another of the roller elements is engaged on the back of the carrier plate.

2. The floor mop according to claim 1, wherein the two carrier plates (5) are moved into an extended position by a spring device (18).

3. The floor mop according to claim 1, wherein the guide surface (17) of each carrier plate (5) rises to an elevation (17*b*) that projects upwards from the back of the carrier plate (5), in a direction towards a free plate end (5*a*).

4. The floor mop according to claim 3, wherein the guide surface (17) decreases in height on the side of the elevation (17*b*) facing the free plate end (5*a*), towards the carrier plate (5).

5. The floor mop according to claim 1, wherein the roller element is a roller (12) that is mounted to rotate on the wringer arm (11).

6. The floor mop according to claim 1, wherein the roller element is a ball (15) that is held to rotate in a recess (14) of the wringer arm (11).

7. A floor mop comprising: two carrier plates connected to a common carrier center piece in jointed manner and which carry an absorbent mop covering, a mop handle affixed on the carrier center piece, and a wringer slide which is movable along the mop handle, the wringer slide having two rigid wringer arms, each of which is movably engagable with a back of one of the two carrier plates, wherein the mop handle (1) is connected with the carrier center piece (3) by way of a cardan joint (2), and ends (11*a*) of the wringer arms (11) can each be brought into engagement with a guide surface (17) on the back of the carrier plate (5) assigned to them, in each instance, and the wringer slide (9) is guided on the mop handle (1) so that it cannot rotate, wherein the end (11*a*) of each wringer arm (11) carries a rotating roller element (12, 15, 20), and wherein the roller element is a wheel (20) provided with recesses (19) on its circumference, which engages with at least one projection (21, 22) on the back of the carrier plate (5).

8. A floor mop comprising: two carrier plates connected to a common carrier center piece in jointed manner and which carry an absorbent mop covering, a mop handle affixed on the carrier center piece, and a wringer slide which is movable along the mop handle, the wringer slide having two rigid wringer arms, each of which is movably engagable with a back of one of the two carrier plates, wherein the mop handle (1) is connected with the carrier center piece (3) by way of a cardan joint (2), and ends (11*a*) of the wringer arms (11) can each be brought into direct contact with a guide surface (17) on the back of the carrier plate (5) assigned to them, in each instance, and the wringer slide (9) is guided on the mop handle (1) so that it cannot rotate;

wherein the end (11*a*) of each wringer arm (11) has a pressure surface (16) with a convex curvature, wherein the arms move into and out of engagement with the carrier plates, and the ends of the arms are configured with roller elements such that each of the roller elements contacts the back of one of the two carrier plates and each of the roller elements may independently be disengaged from the back of the carrier plate while another of the roller elements is engaged on the back of the carrier plate.

9. A floor mop comprising: two carrier plates connected to a common carrier center piece in jointed manner and which carry an absorbent mop covering, a mop handle affixed on the carrier center piece, and a wringer slide which is movable along the mop handle, the wringer slide having two rigid wringer arms, each of which is movably engagable with a back of one of the two carrier plates, wherein the mop handle (1) is connected with the carrier center piece (3) by way of a cardan joint (2), and ends (11*a*) of the wringer arms (11) can each be brought into engagement with a guide surface (17) on the back of the carrier plate (5) assigned to them, in each instance, and the wringer slide (9) is guided on the mop handle (1) so that it cannot rotate, wherein the end (11*a*) of each wringer arm (11) carries a rotating roller element (12, 15, 20), and wherein the guide surface (17) has a flat longitudinal groove (17*a*) with a concave cross-section.

10. A floor mop comprising: two carrier plates connected to a common carrier center piece in jointed manner and which carry an absorbent mop covering, a mop handle affixed on the carrier center piece, and a wringer slide which is movable along the mop handle, the wringer slide having two rigid wringer arms, each of which is movably engagable with a back of one of the two carrier plates, wherein the mop handle (1) is connected with the carrier center piece (3) by way of a cardan joint (2), and ends (11*a*) of the wringer arms (11) can each be brought into engagement with a guide surface (17) on the back of the carrier plate (5) assigned to them, in each instance, and the wringer slide (9) is guided on the mop handle (1) so that it cannot rotate, wherein the end (11*a*) of each wringer arm (11) has a pressure surface (16) with a convex curvature, and wherein the guide surface (17) has a flat longitudinal groove (17*a*) with a concave cross-section.

11. A floor mop comprising:

a common carrier center piece;

two carrier plates connected to the carrier center piece;

a mop covering supported by the carrier plates;

a mop handle;

a joint arrangement configured to connect the mop handle to the carrier center piece; and a wringer slide guideably moveable along the mop handle, the wringer slide having two wringer arms movably engagable with respective backs of the carrier plates; wherein the joint arrangement is configured to permit the carrier center piece to pivot to all sides and is configured to prevent the carrier center piece from rotating, wherein the arms move into and out of engagement with the carrier plates, and the ends of the arms are configured with roller elements such that each of the roller elements contacts the back of one of the two carrier plates and each of the roller elements may independently be disengaged from the back of the carrier plate while another of the roller elements is engaged on the back of the carrier plate.

12. The floor mop according to claim 11, wherein the joint arrangement includes a cardan joint.

13. The floor mop according to claim 11, further comprising a spring device configured to position the carrier plates into an extended position.

14. The floor mop according to claim 11, wherein the carrier plates include respective free plate ends and respective guide surfaces projecting from the backs of the carrier plates in directions toward the respective free plate ends.

15. The floor mop according to claim 11, wherein the roller elements include respective rollers configured to rotate.

16. The floor mop according to claim 11, wherein the roller elements include respective balls configured to rotate in respective recesses of the wringer arms.

17. A floor mop comprising:

a common carrier center piece;

two carrier plates connected to the carrier center piece;

a mop covering supported by the carrier plates;

a mop handle;

a joint arrangement configured to connect the mop handle to the carrier center piece; and a wringer slide guideably moveable along the mop handle, the wringer slide having two wringer arms movably engagable with respective backs of the carrier plates; wherein the joint arrangement is configured to permit the carrier center piece to pivot to all sides and is configured to prevent the carrier center piece from rotating;

wherein ends of the wringer arms carry respective rotating roller elements; and wherein each of the roller elements includes a wheel having a circumference and a plurality of recesses arranged on the circumference to engage with at least one projection on the back of a respective one of the carrier plates.

18. A floor mop comprising:

a common carrier center piece;

two carrier plates connected to the carrier center piece;

a mop covering supported by the carrier plates;

a mop handle;

a wringer slide guideably moveable along the mop handle, the wringer slide having two wringer arms movably engagable with respective backs of the carrier plates; and means for connecting the mop handle to the carrier center piece to permit the carrier center piece to pivot to all sides and to prevent the carrier center piece from rotating, wherein the arms move into and out of engagement with the carrier plates, and the ends of the arms are configured with roller elements such that each of the roller elements contacts the back of one of the two carrier plates and each of the roller elements may independently be disengaged from the back of the carrier plate while another of the roller elements is engaged on the back of the carrier plate.

* * * * *